United States Patent [19]

Sims et al.

[11] Patent Number: 4,706,642

[45] Date of Patent: Nov. 17, 1987

[54] FOLDING CAMP STOVE/OVEN APPARATUS

[76] Inventors: Graham D. Sims; G. Wyatt Sims, both of P.O. Box 21405, Billings, Mont. 59104

[21] Appl. No.: 865,868

[22] Filed: May 22, 1986

[51] Int. Cl.[4] ..... F24C 1/16

[52] U.S. Cl. ..... 126/9 R; 126/9 B

[58] Field of Search ..... 126/9 R, 9 A, 9 B, 4, 126/25 R, 30, 38, 43 R, 59.5

[56] References Cited

U.S. PATENT DOCUMENTS

| | | | |
|---|---|---|---|
| 523,920 | 7/1894 | Sinclair | 126/9 R |
| 584,259 | 6/1897 | Boxler | 126/9 R |
| 967,447 | 8/1910 | Schmidt | 126/9 R |
| 1,051,217 | 1/1913 | Goldberg | 126/9 R |
| 1,173,145 | 2/1916 | Klunk | 126/9 R |
| 1,229,432 | 6/1917 | Ferdon | 126/43 X |
| 1,411,596 | 4/1922 | Tallman | 120/9 R |
| 1,487,737 | 3/1924 | Goldberg et al. | 126/9 B |
| 1,865,025 | 4/1932 | Carstenbrook | 126/9 R |
| 1,991,135 | 2/1935 | Brown | 126/38 |
| 2,129,371 | 9/1938 | Robinson | 126/9 R |
| 2,244,935 | 6/1941 | Binger | 126/9 R |
| 2,485,667 | 10/1949 | Sims | 126/9 R |
| 3,489,131 | 1/1970 | Richins | 126/9 R |

*Primary Examiner*—Samuel Scott
*Assistant Examiner*—H. A. Odar
*Attorney, Agent, or Firm*—Arthur L. Urban

[57] ABSTRACT

Folding camp stove/oven apparatus includes a first housing portion, a second housing portion, a leg portion and leg retaining portion. The first housing portion includes a quadrangular bottom section and two pivotally connected sidewall sections extending upwardly from opposite bottom section with an intermediate divider section edges. The second housing portion includes a quadrangular top section and two pivotally connected endwall sections extending downwardly from opposite edges of the top section with U-shaped sections extending therefrom. Single flange sections that extend frome edges of the top section bear against the endwall sections. A smoke pipe opening is located in the top section. First and second openings with cover members are located in two of the sidewall or endwall sections. The leg portion includes a pair of leg assemblies, each including two right angle leg members spaced to engage adjacent lower corners of the apparatus with spaced parallel connector members joining same. A first connector member joins upper sections of faces of the leg members disposed in the same plane. A second connector member spaced lower than the first connector member joins faces of the leg members disposed in parallel planes with the spacing between the connector members being sufficient to permit sliding the leg assemblies over the combined first and second housing portions when folded in a flat configuration. The leg retaining portion includes first retainers disposed adjacent an edge of the bottom section and second retainers extend downwardly from the bottom section spaced from the bottom section edge.

10 Claims, 10 Drawing Figures

FOLDING CAMP STOVE/OVEN APPARATUS

This invention relates to a novel camp stove and more particularly relates to a new folding stove/oven apparatus.

It was common in the past for persons who were in the wilderness to build open fires for warmth and cooking. Even today, a few outdoorsmen still build open fires when they are camping primitively. Although open fires can be started very quickly, they are not efficient either for warmth or for cooking. Also, such fires are restricted to open locations and generally cannot be used safely inside of shelters.

Because of the limitations of open fires, efforts were directed to designing stoves capable of providing efficiently heat for warmth and cooking. Original stove designs were simple metal boxes that stood on legs. While such stoves in the past were used by many people, they were not completely satisfactory. One shortcoming was the large space that they occupied when they were being transported from one location to another.

To solve this problem, stoves were developed that could be folded into a more compact configuration. Stoves of this type are described in U.S. Pat. Nos. 718,412; 1,118,537; 2,119,799 and 2,485,667. A folding camp stove of the last patent, Sims U.S. Pat. No. 2,485,667, has achieved wide acceptance because of its efficient and troublefree performance.

Through the years, outdoorsmen have been inclined to cook more elaborate meals including baked items. Although it has been suggested that foods can be baked on a stove top, the risk of failure is great. To achieve successful baking, a variety of stoves with ovens were proposed. Examples of such stove/oven combinations are described in U.S. Pat. Nos. 523,920; 618,014; 620,345; 828,801 and 878,862.

Although stove/oven combinations have been offered to the public, many campers were not willing to discard their Sims stoves because of the many years of troublefree service they had enjoyed with the Sims stove. If a compromise in their cooking habits had to be accepted, they preferred to eliminate baked foods from their menus rather than use a stove/oven combination that they considered to be inferior to the Sims stove performance.

It has been suggested that an oven be incorporated in the Sims stove. Looking to previous stove/oven combinations, however, did not provide an answer on how to achieve the result. The known stove/oven combinations were of completely different designs from the Sims stove and did not suggest any way to incorporate an oven in the Sims stove without sacrificing desired features.

From the above discussion, it is clear that previous folding camp stoves and stove/oven combinations did not provide the performance capabilities desired by certain campers. Thus, there is a need for a new folding camp stove which provides the efficiency and other performance characteristics of the Sims stove and in addition provides an oven of the same high standards for the preparation of baked foods.

The present invention provides a novel folding camp stove/oven apparatus which overcomes the deficiencies of previous camp stoves and stove/oven combinations. In addition, the stove/oven apparatus of the invention provides features and advantages not found in previous stoves.

The stove/oven apparatus retains the desired performance characteristics of the Sims stoves, that is, ease of erection, folding and transport, efficient rapid cooking, absence of smoking, etc. Without compromising the high standards of the Sims stove, the stove/oven apparatus of the present invention provides an integrally formed oven of large size and good access, with excellent baking characteristics.

The folding camp stove/oven apparatus of the present invention is simple in design and can be produced relatively inexpensively. Commerically available materials and components can be used in the fabrication of the apparatus. Conventional metal working techniques and procedures and semi-skilled labor can be utilized in the manufacturing of the apparatus.

The camp stove/oven apparatus can be erected quickly and easily by persons with limited experience and aptitude without special tools. Similarly, the apparatus can be folded and secured into a thin package for transport and storage rapidly and conveniently.

The stove/oven apparatus cooks food quickly and efficiently both on the top surface and in the oven. Wood can be loaded into the firebox easily. The firebox is air tight so smoking is reduced to a minimum.

The stove/oven apparatus has good structural integrity. It is durable in construction and has a long useful life. Little, if any, maintenance is required to keep the apparatus in working condition.

Other benefits and advantages of the novel folding camp stove/oven apparatus of the present invention will be apparent from the following description and the accompanying drawings in which.

Figure 1:
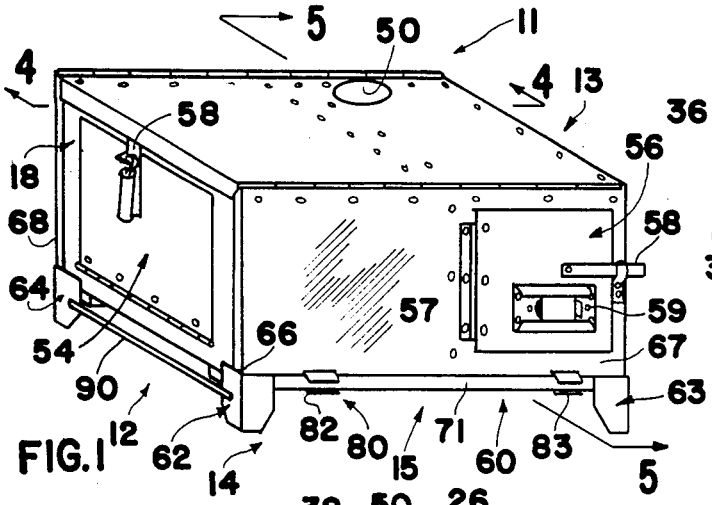
FIG. 1 is a view in perspective of one form of the folding camp stove/oven apparatus of the invention.

As shown in the drawings, one form of the novel folding camp stove/oven apparatus 11 of the present invention includes a first lower housing portion 12, a second upper housing portion 13, a leg portion 14 and a leg assembly retaining portion 15.

The first lower housing portion 12 includes a quadrangular bottom section 17 and two sidewall sections 18 and 19 extending upwardly from opposite edges 20 and 21 of the bottom section. A divider section 22 having the same configuration as the sidewall sections extends upwardly from the bottom section 17. The divider section 22 extends upwardly from the bottom section intermediate the sidewall sections 18 and 19 and is substantially parallel to those sections. Advantageously, the divider section is located adjacent the center of the bottom section. The sidewall and divider sections are pivotally connected to the bottom section through full length piano type hinge means 23, 24 and 25.

The second upper housing portion 13 of the stove-/oven apparatus 11 includes a quadrangular top section 26 having the same configuration as the bottom section 17. Two endwall sections 27 and 28 extend downwardly from opposite edges 29 and 30 of the top section.

The endwall sections are pivotally connected to the top section through full length piano type hinge means 31 and 32 which are similar to the hinges 23–25 of the first housing portion 12. The height of the sidewall sections 18 and 19, the divider section 22 and the endwall sections 27 and 28 advantageously is less than the width thereof.

The second upper housing portion 13 also includes U-shaped flange sections 33 and 34 that extend perpendicularly along each free edge 35 and 36 of the top and endwall sections 26–28. The U-shaped flange sections 33 and 34 are integrally formed with the top and endwall sections. An elongated U-shaped sealing section 38 extends downwardly from the top section 26 between the endwall sections 27 and 28. The sealing section is substantially perpendicular thereto.

The U-shaped sections 33, 34 and 38 are engageable with free edges 40, 41 and 42 of the bottom, sidewall and divider sections 17, 18, 19 and 22. Single flange sections 43 and 44 extend from the edges 29 and 30 of the top section 26 adjacent the endwall sections 27 and 28 and bear against such endwall sections.

The top section 26 includes an opening 50 therein into which an end of a smoke pipe (not shown) is inserted. The opening 50 is located adjacent one hinge means 32 and also adjacent the elongated U-shaped sealing section 38.

Openings are located in two of the sidewall and endwall sections 18, 19, 27 and 28. A first opening 51 located in one of these sections provides access to the interior of the apparatus 11, preferably into the area providing an oven space 47. Advantageously, the opening 51 is of a generally rectangular configuration and occupies a major part of the section in which it is located. Supports 48 preferably are secured to wall sections of the oven space 47 for placement of appropriate shelves (not shown).

A second opening 52 is located remote from the first opening 51 and also remote from the smoke pipe opening 50. The second opening 52 communicates with the smoke pipe opening through a firebox area 49 of the apparatus. The second opening 52 advantageously is smaller in size than the first opening and preferably is located adjacent an end 53 of an endwall section that is remote from the first opening.

Figure 3:
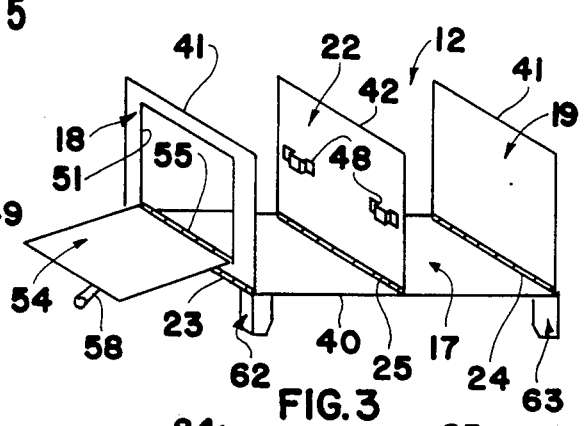
FIG. 3 is a view in perspective of a lower housing portion of the stove/oven apparatus shown in FIG. 1.
Figure 5:
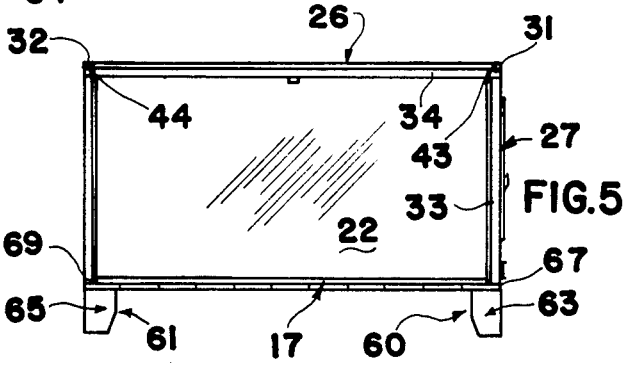
FIG. 5 is a sectional view of the stove/oven apparatus shown in FIG. 1 taken along line 5—5 thereof.

A pivotally connected cover member is disposed over each of the first and second openings 51 and 52. Advantageously, the cover member 54 over the first opening 51 is pivotally connected along a bottom edge 55 thereof as shown in FIG. 3. Cover member 56 over the second opening 52 preferably is pivotally connected along a side edge 57 thereof remote from a corner of the apparatus 11. The cover members 54 and 56 advantageously include latch means 58 and the cover member 56 preferably includes adjustable damper means 59.

Leg portion 14 of the camping stove/oven apparatus 11 of the present invention includes a pair of leg assemblies 60 and 61. Each of the leg assemblies includes two leg members, either 62 and 63 or 64 and 65. The leg members are spaced to engage adjacent lower corners 66 and 67 or 68 and 69 of the apparatus 11. The leg members 62–65 have a right angle configuration.

Spaced parallel connector members 71 and 72 join two leg members into a leg assembly. First connector member 71 joins upper sections of faces 73 and 74 of the respective leg members that are disposed in the same plane, that is, a plane of either of the endwall sections 27 or 28. Second connector member 72 of each leg assembly spaced lower than the first connector member joins faces 75 and 76 of the leg members that extend in parallel planes from the common plane of faces 73 and 74.

Leg assembly retaining portion 15 of the stove/oven apparatus 11 includes first retaining means 80 disposed adjacent to an edge of the bottom section 17. The first retaining means is selectively engageable with the first connector member 71. Second retaining means 81 extends downwardly from the bottom section 17. The second retaining means is selectively engageable with the second connector member 72.

The first retaining means 80 advantageously includes a pair of spaced open channel members 82 and 83. These channel members preferably are mounted along the lower edge of an endwall section 27 as shown in FIG. 1. The second retaining means 81 advantageously includes a pair of spaced clip members 84 and 85. These clip members preferably include hook sections 87 and 88 that press the connector member 72 against the bottom section. Advantageously, the leg members of different leg assemblies are joined by tie members 90 that are detachably interconnected to provide greater rigidity to the apparatus 11.

Figure 2:
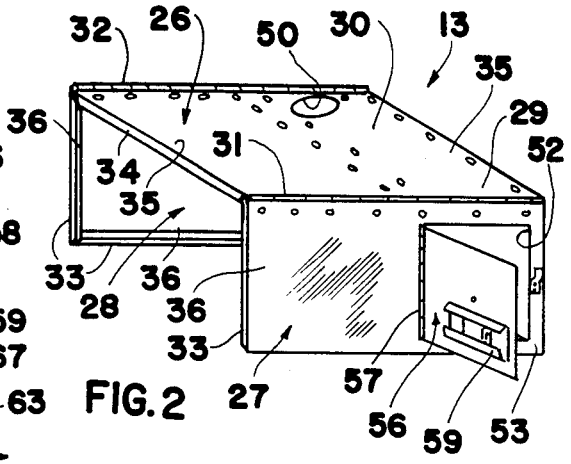
FIG. 2 is a view in perspective of an upper housing portion of the stove/oven apparatus shown in FIG. 1.
Figure 4:
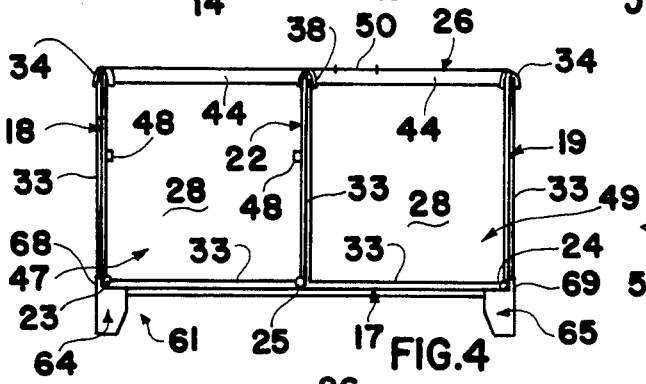
FIG. 4 is a sectional view of the stove/oven apparatus shown in FIG. 1 taken along line 4—4 thereof.
Figure 6:
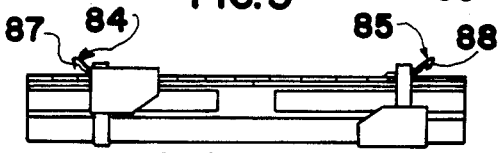
FIG. 6 is a side view of the stove/oven apparatus shown in FIG. 1 in a flat folded configuration.
Figure 7:
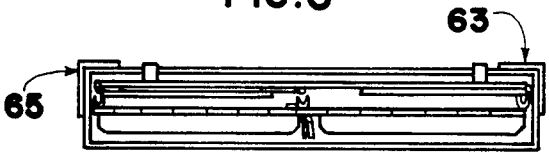
FIG. 7 is a left end view of the stove/oven apparatus shown in FIG. 6.
Figure 8:
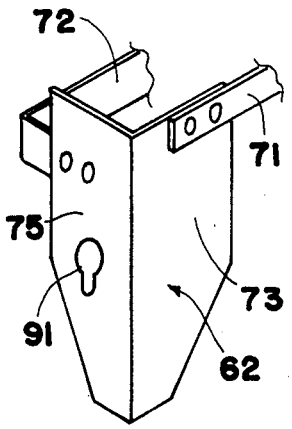
FIG. 8 is an enlarged view in perspective of the left front leg member of the stove/oven apparatus shown in FIG. 1.
Figure 9:
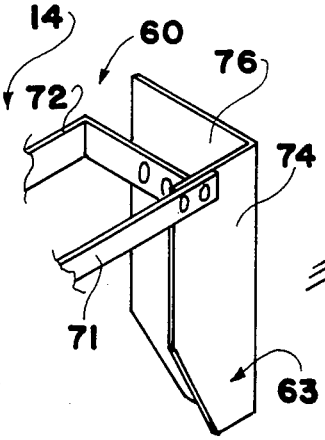
FIG. 9 is an enlarged view in perspective of the right front leg member of the stove/oven apparatus shown in FIG. 1.
Figure 10:
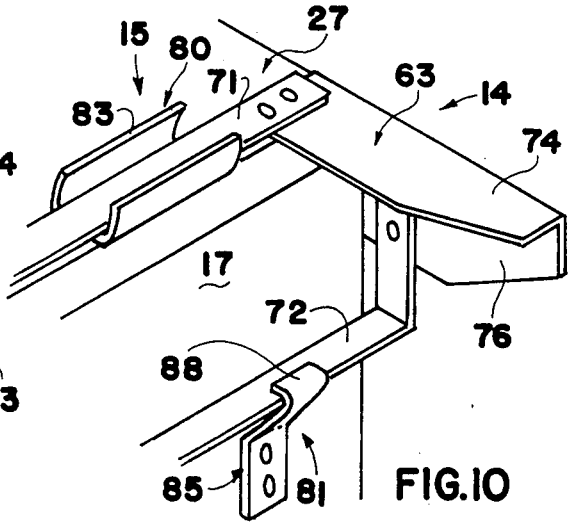
FIG. 10 is an enlarged view in perspective from below with right front leg member secured to the stove-/oven apparatus shown in FIG. 1.

To erect the stove/oven apparatus 11 from its folded package as shown in FIGS. 6 and 7, leg assemblies 60 and 61 are slid from the ends of the package. This allows the folded first and second housing portions 12 and 13 to be separated from one another. The portions then are unfolded to form the configurations shown in FIGS. 2 and 3 of the drawings.

The second upper housing portion 13 is inverted and placed on the ground with the endwall sections 27 and 28 extending upwardly. Then, the first lower portion 12 also is inverted so the sidewall sections 18 and 19 extend downwardly and is placed over the second housing portion with the bottom portion 17 positioned above the top section 26. The sidewall sections 18 and 19 extend between the endwall sections 27 and 28 and are perpendicular thereto.

The free edges of the sidewall and bottom sections are inserted into the adjacent corresponding U-shaped sections 33, 34 and 38 extending upwardly from the endwall and top sections. The endwall sections are rotated into contact with the sidewall edges to achieve this union.

The leg assemblies 60 and 61 hold the assembled first and second housing portions together. To accomplish this, the second connector member 72 of each leg assembly is placed under the hook sections 87 and 88 extending from the bottom section 17 and the leg members 73 and 74 pulled over the adjacent lower corners of the apparatus.

This movement brings the first connector member 71 of the leg assembly close to the channel members 82 and 83 along the lower edge of the endwall 27. The first connector member then is sprung into the channel members to complete the mounting of the leg assembly. The second leg assembly is mounted in the same way as the first.

To increase the rigidity of the leg assemblies, tie sections 90 may be interconnected between leg members of different assemblies by inserting rivets located in the ends of the tie members into key slots 91 in the respective leg members. The stove/oven apparatus 11 then is turned on its legs and placed in a desired location for cooking. A smoke pipe (not shown) is inserted into the opening 50 in the top section and the apparatus 11 is ready for use.

Fuel is loaded into the firebox area 49 through the second opening 52 and the cover member 56 closed. The damper 59 is opened and the fire is started. With the smoke pipe opening 50 located close to the oven space 47 at the end of the firebox remote from the access opening 52, the hot gases that are formed as the fuel burns move along the divider section 22 to uniformly heat the oven space prior to exhausting through the smoke pipe. At the same time, the top surface 26 is heated to provide an area for surface cooking.

When the cooking and baking operations are completed and space heating is not required, the fire in the firebox is allowed to burn out and the apparatus cools. Thereafter, the stove/oven apparatus can be knocked down by repeating the steps followed in the erection of the apparatus, but in reverse order. When the components have been separated, the first and second housing portions 12 and 13 are folded and combined into a flat package which is held together by slipping the leg assemblies 60 and 61 over the package. The package now can be handled easily and conveniently for transport and/or storage in a small space.

The camp stove/oven apparatus of the present invention ordinarily is fabricated of sheet metal. However, it may be possible for certain uses to substitute other structural materials that retain their structural integrity at high temperatures.

The above description and the accompanying drawings show that the present invention provides a novel folding camp stove/oven apparatus which overcomes the limitations of previous stoves and stove/oven combinations as well as providing features and advantages not found in earlier models. The stove/oven apparatus of the invention provides an oven with excellent baking characteristics without compromising the high standards of the widely accepted Sims stove.

The stove/oven apparatus of the present invention is simple in design and can be fabricated relatively inexpensively with commercially available materials and components. The apparatus is durable in construction and has good structural integrity and rigidity. The apparatus has a long useful life with a minimum maintenance.

The stove/oven apparatus can be erected quickly and easily by persons with limited experience and aptitude and folded again as conveniently for transport and storage in a small space. The stove/oven of the invention enables a person to cook and bake foods easily and efficiently with a high degree of success.

It will be apparent that various modifications can be made in the particular stove/oven apparatus described in detail above and shown in the drawings within the scope of the present invention. The size, configuration and arrangement of components can be changed to meet specific requirements. The access openings can be located at different points around the periphery of the apparatus. Also, other latches and dampers can be employed with the cover members that are disposed over the access openings. These and other changes can be made in the stove/oven apparatus described and shown provided the functioning and operation thereof are not adversely affected. Therefore, the scope of the present invention is to be limited only by the following claims.

What is claimed is:

1. Folding camp stove/oven apparatus including a first housing portion, a second housing portion, a leg portion and leg retaining portion; said first housing portion including a quadrangular bottom section and two sidewall sections extending upwardly from opposite edges of said bottom section, a divider section having the same configuration as said sidewall sections and extending upwardly from said bottom section intermediate said sidewall sections and substantially parallel thereto, said sidewall and divider sections being pivotally connected to said bottom section through full length piano type hinge means; said second housing portion including a quadrangular top section and two endwall sections extending downwardly from the opposite edges of said top section, said endwall sections being pivotally connected to said top section through full length piano type hinge means, U-shaped flange sections extending perpendicularly along each free edge of said top and endwall sections, said U-shaped flange sections being integrally formed with said top and endwall sections, an elongated U-shaped sealing section extending downwardly from said top section between said endwall sections and substantially perpendicular thereto, said U-shaped sections being engageable with free edges of said bottom, divider and sidewall sections, single flange sections extending from edges of said top section adjacent said endwall sections and bearing against same, a smoke pipe opening located in said top section adjacent one hinge means and adjacent said elongated U-shaped section, a first opening in one of said sidewall or endwall sections providing access to the interior of said apparatus, a second opening in another of said sidewall or endwall sections, said second opening being located remote from said first opening and remote from said smoke pipe opening but communicating therewith, a pivotally connected cover member disposed over each of said first and second openings; said leg portion including a pair of leg assemblies, each of said leg assemblies including two leg members spaced to engage adjacent lower corners of said apparatus, said leg members having a right angle cross section, spaced parallel connector members joining said leg members, a first connector member joining upper sections of first faces of said leg members disposed in the same plane, a second connector member spaced lower than said first connector member joining spaced parallel second faces of said leg members disposed substantially perpendicular to said first faces thereof, the spacing between said connector members being sufficient to permit sliding of said leg assemblies over said combined first and second housing portions when folded in a flat configuration; said leg retaining portion including first retaining means including a pair of spaced open channel members disposed along an outwardly facing lower edge of said bottom section and selectively engageable with said first connector member and second retaining means including a pair of spaced biasing clip members extending downwardly for said bottom section spaced from said bottom section edge and selectively engageable with said second connector member.

2. A folding stove/oven apparatus according to claim 1 wherein the height of said sidewall, divider and endwall sections is less than the width thereof.

3. A folding stove/oven apparatus according to claim 1 wherein said divider section is located adjacent the center of said bottom section.

4. A folding stove/oven apparatus according to claim 1 wherein first opening is of a generally rectangular configuration occupying a major part of one sidewall or endwall section.

5. A folding stove/oven apparatus according to claim 4 wherein said cover member over said first opening is pivotally connected along a bottom edge thereof.

6. A folding stove/oven apparatus according to claim 1 wherein said second opening is disposed in a sidewall or endwall section adjacent an end thereof remote from said first opening.

7. A folding stove/oven apparatus according to claim 6 wherein said cover member over said second opening is pivotally connected along a side edge remote from a corner of said apparatus.

8. A folding stove/oven apparatus according to claim 1 wherein said cover member over said second opening includes adjustable damper means.

9. A folding stove/oven apparatus according to claim 1 wherein said cover members include latch means.

10. A folding stove/oven apparatus according to claim 1 wherein said leg assemblies are interconnected by separate tie members.

* * * * *